US007387514B2

(12) United States Patent
Bienert

(10) Patent No.: US 7,387,514 B2
(45) Date of Patent: Jun. 17, 2008

(54) ROTARY BEARING WITH CURRENT FEED-THROUGH MEANS

(75) Inventor: Olaf Bienert, Waldems (DE)

(73) Assignee: Poly-Clip System GmbH & Co. KG (DE)

( * ) Notice: Subject to any disclaimer, the term of this patent is extended or adjusted under 35 U.S.C. 154(b) by 93 days.

(21) Appl. No.: 10/599,115

(22) PCT Filed: Mar. 24, 2005

(86) PCT No.: PCT/EP2005/003173

§ 371 (c)(1),
(2), (4) Date: Sep. 20, 2006

(87) PCT Pub. No.: WO2005/093913

PCT Pub. Date: Oct. 6, 2005

(65) Prior Publication Data

US 2007/0218708 A1 Sep. 20, 2007

(30) Foreign Application Priority Data

Mar. 29, 2004 (DE) ..... 10 2004 015 313

(51) Int. Cl.
*H01R 29/00* (2006.01)

(52) U.S. Cl. ..... 439/21

(58) Field of Classification Search ..... 439/21, 439/31, 15, 22, 164, 165; 361/689, 729, 361/679; 310/232, 233
See application file for complete search history.

(56) References Cited

U.S. PATENT DOCUMENTS 3,937,543 A 2/1976 Tomaro
5,238,444 A 8/1993 Schwimmer et al.
5,346,400 A * 9/1994 Shin ..... 439/17
5,498,163 A * 3/1996 Takamura et al. ..... 439/13
5,934,911 A 8/1999 Stout et al.
6,265,803 B1 * 7/2001 Caveney ..... 310/219
6,350,155 B1 2/2002 Mullinger-Bausch et al.
6,586,858 B1 * 7/2003 Finkle ..... 310/233
6,796,801 B2 * 9/2004 Hayashi ..... 439/15
6,808,402 B2 * 10/2004 Ryu et al. ..... 439/165

FOREIGN PATENT DOCUMENTS

DE 2 047 456 C 12/1971
DE 25 38 766 A1 8/1976
DE 41 25 949 C2 6/1996
DE 297 17 068 U1 3/1999
DE 199 12 000 A1 10/2000
DE 202 16 305 U1 1/2004

* cited by examiner

*Primary Examiner*—Alexander Gilman
(74) *Attorney, Agent, or Firm*—Hahn Loeser & Parks LLP; Michael H. Minns

(57) ABSTRACT

The invention concerns a rotary bearing with current feed-through means, in particular for a sausage clipping machine, wherein the rotary bearing has a bearing casing and a bearing shaft rotatably accommodated therein and wherein the bearing casing and the bearing shaft are at least partially made from an electrically conducting material. It is further provided that there is at least one current path which passes through the bearing casing and the bearing shaft and which is electrically insulated at least with respect to the electrically conducting portions of the bearing shaft and the bearing casing and which has at least one outer connecting terminal on the bearing casing and the bearing shaft respectively.

20 Claims, 1 Drawing Sheet

ROTARY BEARING WITH CURRENT FEED-THROUGH MEANS

This application is a national stage of PCT International application no. PCT/EP2005/003173 filed Mar. 24, 2005, which claims priority to German application Serial No. 10 2004 015 313.2 filed Mar. 29, 2004, herein incorporated by reference.

TECHNICAL FIELD

The invention concerns a rotary bearing with current feed-through means, in particular for a sausage clipping machine, as set forth in the classifying portion of claim 1.

BACKGROUND OF THE INVENTION

In the case of complex machines it is often necessary for electrical energy to be passed to regions which are far away from the current source or the current connection terminal of the machine. In practice that is very extensively effected by the use of cables. If however the cables are passed along the outside of the machine, they can impede the working region. Furthermore in the case of handling operations in the region of the machine the cables can be damaged and thus represent a risk in regard to the maintenance and/or operating personnel.

Thus for example in the case of a sausage clipping machine it is necessary for the electric motor for a discharge conveyor belt to be connected by way of a cable to the current connection terminal of the machine. In that situation the cable is laid relatively loosely as the discharge conveyor belt is mounted pivotably or rotatably to the machine housing of the clipping machine in order to permit access to the displacement and clipping unit of the clipping machine.

German laid-open application No 199 12 000 discloses a rotary bearing of the kind set forth in the opening part of this specification, which has a bearing casing of electrically conductive material and a bearing shaft rotatably mounted in the bearing casing. Provided in the bearing casing and the bearing shaft is a current path bolt which is arranged in coaxial relationship with the longitudinal center line of the rotary bearing and which has a connection terminal lug at its one end and a contacting pin at its other end. That known rotary bearing is provided in the form of a plug connector for a mobile telephone. For the purposes of separating the bearing casing from the bearing shaft the entire rotary bearing has to be broken down into its individual parts.

German patent No 20 47 456 discloses a connecting portion for electrically conductingly fixing a connecting cable to a counterpart portion with a contact pin connected to the connecting cable and a permanent magnet which is disposed on the counterpart portion in the area around the contact pin. In that arrangement the contact pin is supported rotatably and displaceably in the axial direction in a holder which is connected to the permanent magnet, wherein a spring which presses the contact pin against the counterpart portion is arranged between the holder and the contact pin.

In addition German laid-open application No 25 38 766 discloses an electrical rotary contact which includes: a carrier disk with a bore, a respective contact disk on each side of the carrier disk with further bores arranged on the same axis with respect to the bore of the carrier disk, a cable connecting portion with an electrically conducting projection, wherein the projection is passed with the interposition of an insulating ring through an electrically conducting ring and through the bores in the carrier disk and the contact disks, and a resilient element for pressing the electrically conducting ring against the one contact disk and for making an electrical connection between the projection and the other contact disk.

German Utility Model No 297 17 068 discloses a door comprising a frame and a door leaf which is hingedly connected to the frame by one or more hinge plates.

Finally German patent specification No 41 25 949 also discloses an apparatus for forming loops on a sausage clipping machine.

SUMMARY OF THE INVENTION

The object of the present invention is to provide a rotary bearing of the kind set forth in the opening part of this specification, which, while being of a simple structure and involving a safe and reliable current passage, permits easy assembly and dismantling of the bearing shaft from the bearing casing.

The foregoing object is attained by the features of claim 1. Subsequent appendant claims 2 through 15 set forth advantageous configurations in respect thereof.

The provision of at least one current path which leads through the bearing housing and the bearing shaft and which is electrically insulated at least in relation to the electrically conducting portions of the bearing shaft and the bearing casing and which has at least one outer connecting terminal provided in the bearing casing and the bearing shaft respectively affords the possibility of providing a current path through the rotary bearing in a simple fashion in spite of the rotary-pivotal function of the rotary bearing, without cables having to be passed at the outside of the rotary bearing. As the current path goes through the bearing casing and the bearing shaft, in addition there is no possibility of damage to or interruption in the current path due to influences from the exterior so that the electrical power supply, which extends by way of the rotary bearing, to an electric motor connected to the current path, is guaranteed.

The bearing casing and the bearing shaft are movable relative to each other. In addition the bearing shaft can be readily withdrawn from the bearing casing in order for example to exchange different machine parts which are held to the bearing shaft for each other. In that case the current path has a current path bolt of electrically conducting material which is fitted in a through bore in the bearing shaft and which at its one end projects out of the bearing shaft and forms the outer connecting terminal of the bearing shaft and which at its other end has a touching contact region which is in electrically conducting relationship with a touching contact region of the bearing casing for forming the touching contact portion of the current path.

In order to be able to guarantee the function of the current path through the rotary bearing even in the event of production tolerances within the individual component parts of the rotary bearing, it is further provided that the touching contact portion or the touching contact region of the current path bolt is elastically biased by means of a spring element, preferably a coil compression spring, in the direction of the touching contact region of the bearing casing, wherein at the end of the bearing shaft which is fixed in the axial position in the direction of the touching contact region of the bearing casing, the spring element is supported, preferably electrically insulated with the interposition of a sliding ring, preferably by an annular insulating layer. In that arrangement the sliding ring prevents damage to the annular insulating layer due to the spring element.

In order in that case to be able to provide a reliable current connection without using cables and the like it is further advantageous if the current path between the bearing shaft and the bearing casing has a touching contact portion which permits at least a rotary movement between the bearing shaft and the bearing casing without loss in respect of the electrical conductivity of the current path and which is composed of a touching contact region at the bearing casing side and a touching contact region at the bearing shaft side. Advantageously the touching contact portion is in the form of a sliding or wiping contact.

In order to be able to ensure the electrical conducting connection to the touching contact portion of the current path even upon the occurrence of vibration, corrosion at the components which belong to the touching contact portion or fouling of those parts, it is further advantageous if the touching contact region at the bearing shaft side and/or the bearing casing side can be axially elastically biased in the contact direction.

If the current path extends in coaxial relationship with the longitudinal center line of the bearing shaft, then it is reliably protected from damage or manipulation from the exterior, in the region of the rotary bearing.

The cable which is used in the state of the art suffers from the disadvantage that it can suffer damage due to sharp-edged objects or malice so that, besides the risk of injury to an operator who can touch the exposed current lines, there is the possibility of an interruption in the current. If in comparison the current path is formed by preferably rigid machine components, then such damage as can occur with a comparatively soft cable cannot arise.

In order to guarantee that current is safely and reliably passed, it is further advantageous if the touching contact region of the current path bolt is of a contact area which is larger in relation to the cross-sectional area of the current path bolt.

To prevent a short-circuit at the outside of the machine housing, it can further be provided that the current path bolt is accommodated in the through bore in the bearing shaft in a sheath, preferably in the form of a sleeve of electrically insulating material.

In order also to prevent a short-circuit by way of the outer connecting terminal of the current path bolt which can be formed for example by a plug terminal lug which is fixed to the current path bolt by means of nuts, the outer connecting terminal of the current path bolt can be electrically insulated with respect to the bearing shaft, preferably by means of an annular insulating layer.

The touching contact region of the bearing casing, which is in opposite relationship to the touching contact region of the bearing shaft, can advantageously be formed from a ring of an electrically conducting material, which is held to the bearing casing and whose contact surface preferably corresponds at least in respect of its outside dimensions to the contact surface of the current path bolt.

In order to achieve simple insulation for the current path with respect to the bearing casing, it is further advantageous if in the direction of the axis of rotation the bearing casing has a first and a second bearing casing portion, wherein the second bearing casing portion is provided in the region of the outer connecting terminal of the bearing casing and comprises an electrically insulating material, preferably a POM plastic material. In that arrangement the second bearing casing portion can accommodate the touching contact region of the current path.

DETAILED DESCRIPTION OF THE DRAWING

Figure 1:
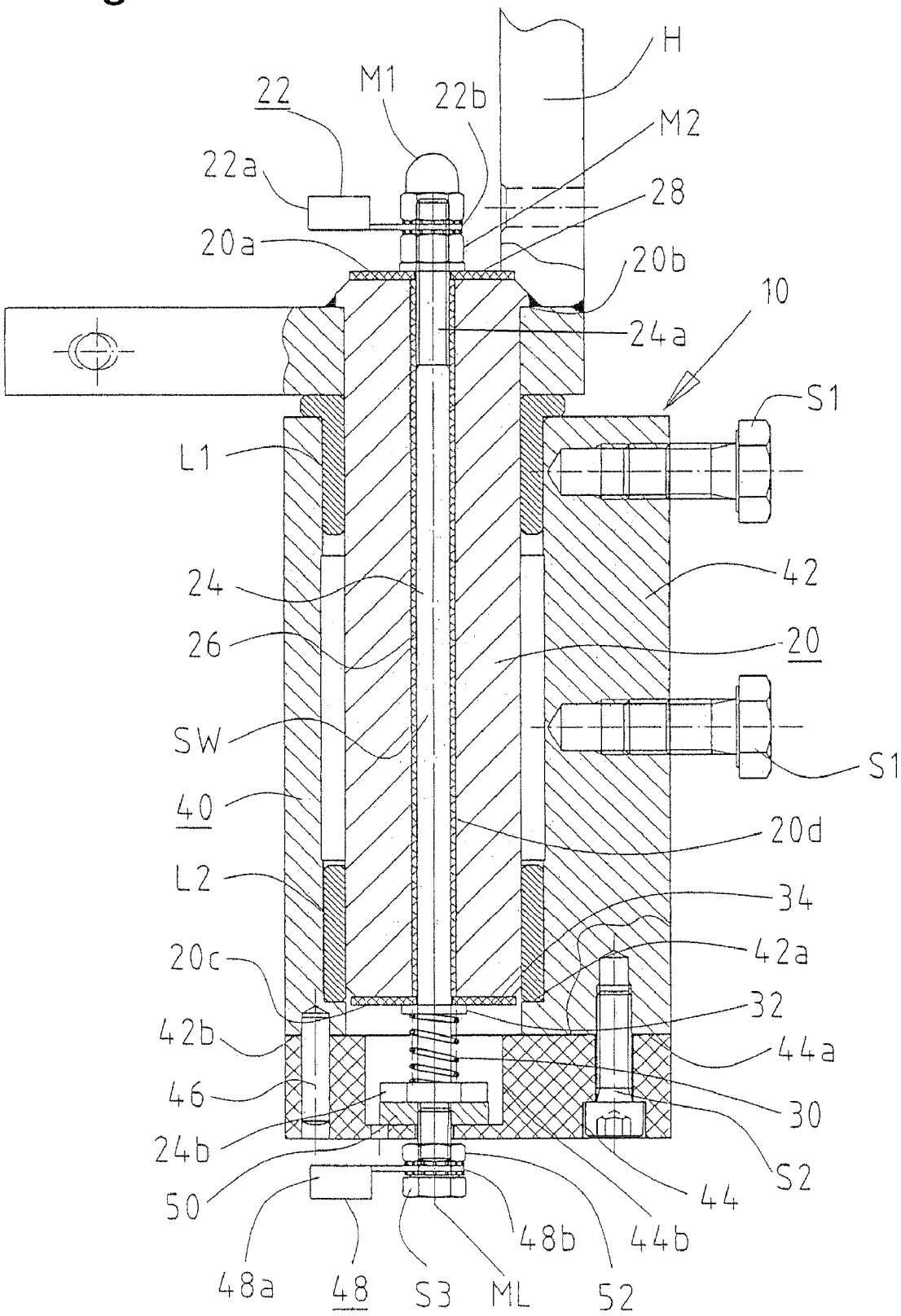
FIG. 1 is a partial, cross-sectional view of an embodiment of the rotary bearing.

Further advantageous configurations and an embodiment by way of example of the rotary bearing according to the invention are described hereinafter with reference to the single accompanying Figure of drawing. In this connection it is to be pointed out that the terms "top", "bottom", "left" and "right" used in the description refer to that Figure in an orientation with the reference numerals being normally readable.

The rotary bearing 10 according to the invention which is shown in longitudinal section in the single FIGURE of drawing has a bearing shaft 20 and a rotary bearing casing 40 as essential structural groups. As can further be seen from the single FIGURE the orientation of the rotary bearing 10 is vertical, that is to say the longitudinal center line ML of the bearing shaft 20, which coincides the axis of the rotary bearing, extends vertically. The rotary bearing 10 according to the invention however is not restricted to that orientation but it can also be used in a horizontal orientation or in an orientation extending inclinedly relative to the horizontal.

The bearing shaft 20 is of a cross-section in the form of a circle and is made from an electrically conducting material such as high-quality steel. Arranged at its upper end 20*a* is a holder H for a machine structural group (not further shown) which is to be rotated or pivoted and which for example can be the discharge conveyor belt of a clipping machine for sausages. In order to axially precisely position the holder H a step 20*b* is provided in the region of the end 20*a* of the bearing shaft 20. As can also be seen from the Figure the holder H is welded to the bearing shaft 20 in the region of the end 20*a* thereof.

The bearing casing 40 is fixed to a machine frame which is also not further illustrated here, such as for example the frame of a clipping machine, by means of screws S1. As can further be seen from the single FIGURE, the bearing casing 40 is divided into two in the axial direction, namely into a first bearing casing portion 42 and a second bearing casing portion 44, with the first casing portion 42 being arranged above the second casing portion 44. The two casing portions 42, 44 are centered relative to each other by means of a centering pin 46 and are releasably connected together by one or more screws S2.

An electrically conducting material such as high-grade steel is also used for the first bearing casing portion 42.

In comparison the second casing portion 44 comprises an electrically non-conducting material such as a POM plastic material. At its side 44*a* which faces towards the first casing portion 42 the second casing portion 44 is provided with a circular recess 44*b* whose longitudinal center line (not referenced) coincides with the longitudinal center line ML of the bearing shaft 20.

The bearing shaft 20 is supported rotatably in the first bearing casing portion 42 by means of two bearing bushes L1 and L2 of brass. In that case the upper bearing bush L1 forms an axial thrust bearing whereas the lower bearing bush L2 represents a radial bearing which is supported against an annular step 42*a* in the region of the lower end 42*b* of the first casing portion 42. The bearing shaft 20 is fixed in position with respect to the bearing casing 40 axially in the direction of the lower end 20*c* of the bearing shaft 20 by the upper bearing bush L1. As can be seen from the single FIGURE in comparison the bearing shaft 20 can be readily removed upwardly, that is to say different bearing shafts 20 with different machine components mounted thereto can be easily fitted into one and the same bearing casing 40, wherein the current passage arrangement according to the invention automatically produces the current path each time without any additional measures.

A current path SW passes through the rotary bearing 10 according to the invention. The current path SW extends from an upper outer connecting terminal or outer connecting element 22 at the bearing shaft side, which comprises an electrically conducting material such as nickel-plated copper and which has a push-on connecting terminal lug 22*a*, through the rotary bearing 10, in a manner still to be described in greater detail hereinafter, to a lower outer connecting terminal or outer connecting element 48 at the bearing casing side, which also comprises an electrically conducting material such as nickel-plated copper and which also has a push-on connecting terminal lug 48*a*. The current flow direction in that case can be both from the upper outer connecting element 22 to the lower outer connecting element 48 and also vice-versa.

In order to electrically conductingly connect the upper outer connecting element 22 to the lower outer connecting element 48 the current path SW further has a current path bolt 24 arranged in a through bore 20*d* in the bearing shaft 20. In order to electrically insulate the current path bolt 24 with respect to the bearing shaft 20 the current path bolt 24 is completely enclosed in the region of the through bore 20*d* in the bearing shaft 20 by a sheath 26 of an electrically insulating material such as a plastic material which is suitable for that purpose. The sheath 26 can be for example in the form of a sleeve which, prior to the current path bolt 24 being inserted into the through bore 20*d* in the bearing shaft 20, is pushed onto the current path bolt 24.

As can further be seen from the single FIGURE the current path bolt 24 projects beyond the upper end 20*a* of the bearing shaft 20. In that region of the current path bolt 24 is provided with a screwthreaded portion 24*a*. The outer connecting element 22 at the bearing shaft side, which element for that purpose has an eye 22*b*, is pushed onto that screwthreaded portion 24*a* and fixed there by means of two nuts M1, M2 which accommodate the eye 22*b* of the outer connecting element 22 between them. In this case the lower nut M2 is supported with the interposition of an upper insulating layer 28 of electrically non-conducting material, wherein the insulating layer 28 overlaps the insulating sheath 26 around the current path bolt 24 at the exit of the current path bolt 24 from the through bore 20*d*. As can also be seen from the Figure in this case the upper nut M1 can be a cap nut.

The current path bolt 24 also projects beyond the lower end 20*c* of the bearing shaft 20 and ends at a head 24*b* whose preferably circular cross-sectional area is larger than the preferably circular cross-sectional area of the current path bolt 24. The surface of the head 24*b*, which faces in the direction of the lower end of the rotary bearing 10, forms a touching contact region in the form of a sliding contact surface which is in electrically conducting relationship with a touching contact region at the bearing casing side, to produce an electrical connection between the current path bolt 24 and the outer connecting element 48 at the bearing casing side. The touching contact region of the bearing casing 40 is formed by a contact ring 50 comprising electrically conducting material such as high-quality steel, which is fixed by means of a screw S3 to the bearing casing 40 in the interior of the recess 44*b* in the second casing portion 44. The surface of the contact ring 50, which faces in the direction of the current path bolt 24, forms the touching contact region at the bearing casing side, which surface can also be provided in the form of the a sliding contact surface. The two sliding contact surfaces of the head 24*b* and the contact ring 50 are in mutually superposed plane-parallel relationship and are approximately of the same outside dimensions. It is also to be noted that the touching contact region of the current path bolt 24 and of the contact ring 50 form the touching contact portion of the current path SW.

The outer connecting element 48 at the bearing casing side, which for this purpose has an eye 48*b*, is pushed onto the screw S3 and secured by means of a lock nut 52 on the screw S3 outside the second casing portion 44.

In order to be able to compensate for manufacturing tolerances between the bearing shaft 20 and the bearing casing 40 the head 24*b* of the current path bolt 24 is urged by means of a compression spring 30 against the contact ring 50 of the bearing casing 40. In this case the compression spring 30 is supported by way of a sliding ring 32 against the lower end 20*c* of the bearing shaft 20 with the interposition of a lower annular insulating layer 34 of an electrically insulating material. It is also to be noted that the lower annular insulating layer 34 overlaps the insulating sheath 26 around the current path bolt 24 at the exit of the current path bolt 24 from the through bore 20*d*.

The invention claimed is:

1. A rotary bearing with current feed-through means for a sausage clipping machine, the rotary bearing comprising:

a bearing casing and a bearing shaft rotatably accommodated therein, wherein the bearing casing and the bearing shaft are at least partially made from an electrically conducting material, at least one current path which is passed through the bearing casing and the bearing shaft and which is electrically insulated at least in relation to the electrically conducting portions of the bearing shaft and the bearing casing and which has at least one outer connecting terminal provided on the bearing casing and the bearing shaft respectively, and wherein the current path has a current path bolt of electrically conducting material which is fitted in a through bore in the bearing shaft, wherein at its one end the current path bolt projects from the bearing shaft and forms the outer connecting terminal of the bearing shaft and at its other end has a touching contact region which is in electrically conducting relationship with a touching contact region of the bearing casing to form the touching contact portion, of the current path, wherein the touching contact portion of the current path bolt is elastically prestressed by means of a spring element in the direction of the touching contact region of the bearing casing, and wherein the spring element is electrically insulatedly supported at the end of the bearing shaft which is fixed in its axial position in the direction of the touching contact region of the bearing casing.

2. The rotary bearing of claim 1, wherein the current path extends in coaxial relationship with the longitudinal center line of the bearing shaft.

3. The rotary bearing of claim 1, wherein the current path is formed by machine elements.

4. The rotary bearing of claim 1, wherein the touching contact region of the current path bolt has a contact surface which is larger than the cross-sectional area of the current path bolt.

5. The rotary bearing of claim 1, wherein the spring element is a coil compression spring.

6. The rotary bearing of claim 1, wherein the spring element is electrically insulatedly supported at the end of the bearing shaft which is fixed in its axial position in the direction of the touching contact region of the bearing casing, with the interposition of a sliding ring.

7. The rotary bearing of claim 1, wherein the spring element is electrically insulatedly supported at the end of the bearing shaft which is fixed in its axial position in the direction of the touching contact region of the bearing casing by an annular insulating layer.

8. The rotary bearing of claim 1, wherein the outer connecting terminal of the current path bolt is electrically insulated with respect to the bearing shaft, preferably by means of an annular insulating layer.

9. The rotary bearing of claim 1, wherein the touching contact region of the bearing casing is formed from a contact ring of an electrically conducting material which is accommodated in the bearing casing and whose contact surface corresponds preferably at least in the outside dimensions thereof to the contact surface of the current path bolt.

10. The rotary bearing of claim 1, wherein the bearing casing has a first and a second bearing casing portion in the direction of the axis of rotation, wherein the second bearing casing portion is provided in the region of the outer connecting terminal of the bearing casing and comprises an electrically insulating material.

11. The rotary bearing of claim 10, wherein the second bearing casing portion accommodates the touching contact portion of the current path.

12. The rotary bearing of claim 1, wherein the insulation for the current path bolt in the interior of the through bore in the bearing shaft and at the ends of the bearing shaft comprises an identical material.

13. The rotary bearing of claim 1, wherein between the bearing shaft and the bearing casing the current path has a touching contact portion which permits at least a rotary movement between the bearing shaft and the bearing casing without loss of the electrical conductivity of the current path and which is composed of touching contact regions at the bearing casing side and the bearing shaft side.

14. The rotary bearing of claim 13, wherein the touching contact portion is in the form of a sliding contact portion.

15. The rotary bearing of claim 13, wherein the touching contact portion at the bearing shaft side and/or the bearing casing side can be axially elastically prestressed in the contact direction.

16. A rotary bearing for a sausage clipping machine, the rotary bearing comprising:

a bearing casing;

a bearing shaft rotatably supported within the bearing casing and extending from one end of the bearing casing;

an electrically conductive bolt positioned through a rotational axis of the shaft and extending from each end of the bearing shaft;

a first electrical connecting terminal attached to a first end of the electrically conductive bolt extending from an end of the bearing shaft;

wherein a second end of the electrically conductive bolt is biased toward and positioned in sliding contact with an electrically conductive portion of the bearing casing;

the electrically conductive portion of the bearing casing being electrically connected to an electrically conductive member, the electrically conductive member extending through an electrically non-conducting portion of the bearing casing and extending away from an end of the bearing casing;

a second electrical connecting terminal attached to the electrically conductive member extending from the bearing casing.

17. The rotary bearing of claim 16, wherein the electrically conductive bolt is insulated from the bearing shaft.

18. The rotary bearing of claim 16, wherein the electrically conductive bolt generally rotates with the bearing shaft in relation to the bearing casing.

19. The rotary bearing of claim 16, wherein the second electrical connecting terminal is fixed with respect to the bearing casing.

20. The rotary bearing of claim 17, wherein at least a portion of the bearing shaft is made of an electrically conductive material.

* * * * *